US012151867B2

(12) United States Patent
Simpkins et al.

(10) Patent No.: US 12,151,867 B2
(45) Date of Patent: Nov. 26, 2024

(54) BAG-IN-BOX CONTAINER

(71) Applicant: WESTROCK SHARED SERVICES, LLC, Atlanta, GA (US)

(72) Inventors: Kevin M. Simpkins, Cumming, GA (US); Jeffrey S. James, Atlanta, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 147 days.

(21) Appl. No.: 17/556,405

(22) Filed: Dec. 20, 2021

(65) Prior Publication Data

US 2023/0192379 A1 Jun. 22, 2023

(51) Int. Cl.

| | |
|---|---|
| ***B65D 77/06*** | (2006.01) |
| ***B65D 5/02*** | (2006.01) |
| ***B65D 5/16*** | (2006.01) |
| ***B65D 5/54*** | (2006.01) |
| ***B65D 5/70*** | (2006.01) |

(52) U.S. Cl.

CPC ..... *B65D 77/065* (2013.01); *B65D 5/0227* (2013.01); *B65D 5/16* (2013.01); *B65D 5/542* (2013.01); *B65D 5/705* (2013.01)

(58) Field of Classification Search

CPC ..... B65D 77/065; B65D 5/0227; B65D 5/16; B65D 5/542; B65D 5/705; B65D 5/4208; B65D 5/701; B65D 77/067; B65D 25/24; B65D 77/068; B65D 5/52; B65D 5/5206; B67D 3/0083

USPC ..... 229/117.3, 117.35, 243, 117.27, 191; 222/105, 92; 220/495.01; 221/302

See application file for complete search history.

(56) References Cited

U.S. PATENT DOCUMENTS

| | | | | |
|---|---|---|---|---|
| 9,079,697 | B2 * | 7/2015 | Brooks | B65D 5/746 |
| 9,567,130 | B1 * | 2/2017 | Drouet | B65D 5/44 |
| D825,327 | S * | 8/2018 | Drouet | D9/414 |
| 10,961,036 | B2 * | 3/2021 | Belgya | B65D 77/067 |
| 2009/0084834 | A1 * | 4/2009 | Duyst | B65D 5/705 229/120.01 |
| 2020/0108994 | A1 * | 4/2020 | Bohache | A47K 5/12 |
| 2021/0047099 | A1 * | 2/2021 | Bulls, Jr. | B65B 5/04 |

* cited by examiner

*Primary Examiner* — Christopher R Demeree
(74) *Attorney, Agent, or Firm* — Neil G. Cohen; Rohini K. Garg

(57) ABSTRACT

Techniques and/or systems are disclosed for a bag-in-box container including a plurality of panels, a plurality of lower flaps configured to enclose a bottom of the bag-in-box container, and a plurality of upper flaps configured to enclose a top of the bag-in-box container. The plurality of panels including a support panel, a side panel adjacent the support panel, a back panel adjacent the side panel, another side panel adjacent the back panel, and a front panel adjacent the side panel, wherein adjacent panels are connected with one another. The plurality of upper flaps comprises a side panel flap hingedly connected to the side panel and having an opening configured to receive a dosing cup. A plurality of legs are configured to be erectable from the plurality of lower flaps. A first line of weakness formed in the front panel, wherein the first line of weakness defines a severable portion that is configured to be removable; and a second line of weakness formed in the support panel, wherein the second line of weakness defines a pivotable portion that is configured to be hingedly connected to the bag-in-box container.

20 Claims, 8 Drawing Sheets

BAG-IN-BOX CONTAINER

FIELD

The present disclosure relates generally to bag-in-box containers that may be used for storing and dispensing flowable compositions. In particular, the present disclosure relates to a bag-in-box container that can be shipped in its own container ("SIOC") and includes an erectable stand with an interlocking feature.

BACKGROUND

Bag-in-box containers for liquid dispensing are in the mass market for use by consumers. These bag-in-box containers require consumers to remove some primitively designed tear off or tear out tab to create an opening in the bag-in-box container so that they can retrieve the tap dispenser from the interior of the bag-in-box container. Typically the bag in the bag-in-box container is just stuffed into the container and the tap dispenser is in a retracted position between folds of the bag and is difficult for the consumer to find, grasp, and extend out of the container so that he or she can dispense the contents of the bag in box container. The consumer must then find a place to put the bag in box container so that he or she can dispense from the tap dispenser. Typically, the tap dispenser is near the bottom of the bag in box container so that most of the liquid contained therein can be dispensed.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, there is provided a bag-in-box container. The bag-in-box container comprises a plurality of panels, a plurality of lower flaps, and a plurality of upper flaps integrally formed in a blank. The plurality of panels including a support panel, a side panel adjacent the support panel, a back panel adjacent the side panel, another side panel adjacent the back panel, and a front panel adjacent the side panel, wherein adjacent panels are connected with one another. The plurality of upper flaps are configured to cooperate with each other to enclose a top of the bag-in-box container, and the plurality of lower flaps are configured to cooperate with each other to enclose a bottom of the bag-in-box container. The plurality of lower flaps comprises: a support panel flap hingedly connected to the support panel, the support panel flap comprising a first flap; a back panel flap hingedly connected to the back panel, the back panel flap comprising a second flap; and a side panel flap hingedly connected to the side panel, the side panel flap comprising a first flap engaging member and a second flap engaging member. The bag-in-box container further comprises a first leg configured to extend from the bottom of the bag-in-box container, the first leg comprising the first flap and the first flap engaging member; and a second leg configured to extend from the bottom of the bag-in-box container, the second leg comprising the second flap and the second flap engaging member. The bag-in-box container further comprises a first line of weakness formed in the front panel, wherein the first line of weakness defines a severable portion of the front panel that is configured to be removable; and a second line of weakness formed in the support panel, wherein the second line of weakness defines a pivotable portion that is configured to be hingedly connected to the bag-in-box container, the support panel being fixedly attached to an inner surface of the front panel such that the first severable portion and the pivotable portion are generally aligned.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
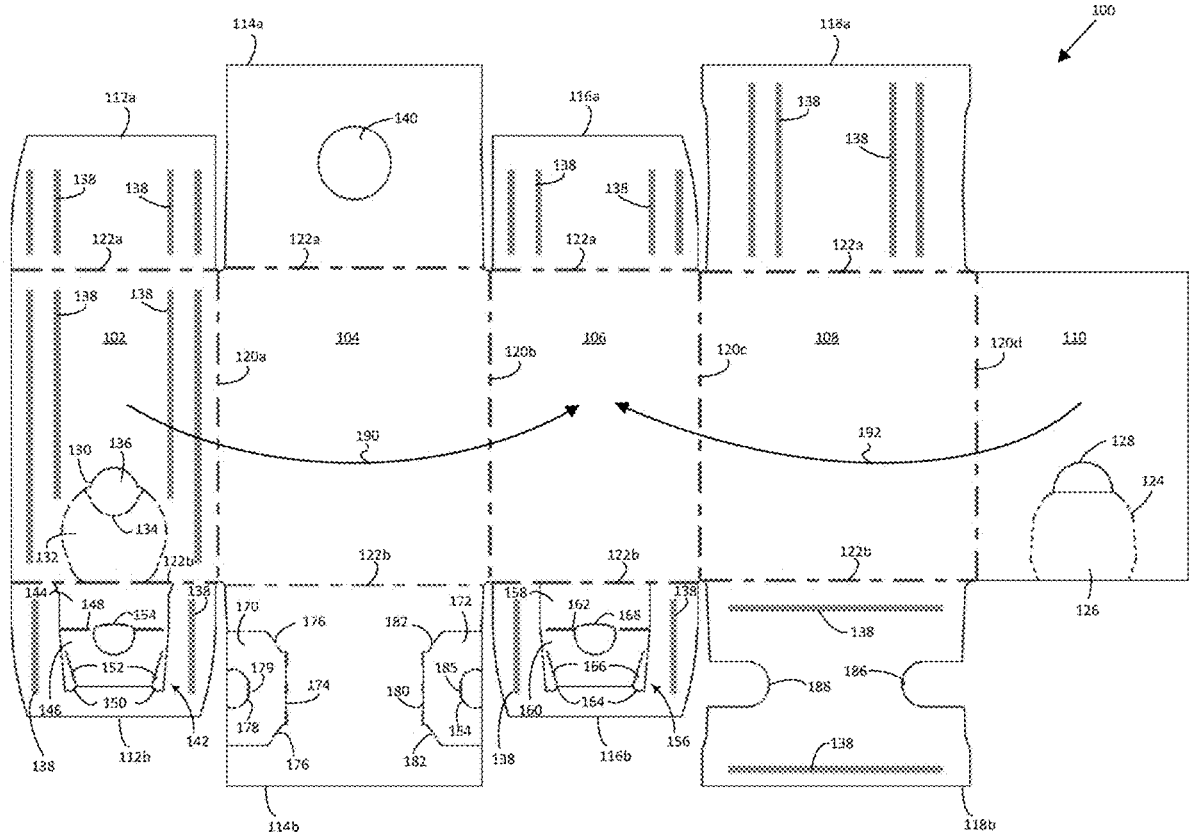
FIG. 1 is a plan view of a blank suitable for forming a bag-in-box container in accordance with this disclosure.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

Referring now to FIGS. 1-3, by way of examples, the present disclosure is generally directed to bag-in-box containers for storing and dispensing a flowable composition such as, for example, liquid laundry detergent, liquid fabric softener, wine, oil, liquid dish detergent, liquid hand soap, liquid condiments, and combinations thereof. More specifically, the present disclosure is directed to a bag-in-box container comprising structures that can be erected to form a plurality of legs upon which the container can stand. Additionally, the bag-in-box container of the present disclosure is directed to a removable panel portion that provides for a gravity fed tap for dispensing fluids and includes a means to support and keep level the tap dispenser.

The bag-in-box container can be machine glued as part of the assembly from the flat blank. The assembled bag-in-box container needs sufficient strength and durability to survive shipping environments, store a bag containing a flowable composition, and be equipped with a removable portion to access and dispense the flowable composition enclosed in the bag contained therein. The bag-in-box container of this disclosure can be practical for delivery from the manufacturer to the consumer via a parcel delivery service because it ships in its own container ("SIOC"). In some non-limiting examples, the bag-in-box container 10 can contain from about 0.5 L to about 30 L, optionally from about 0.5 L to about 10 L, or about 1 L to about 5 L, of liquid. Thus, the container disclosed herein should be produced at the lowest cost possible and have a removable portion for displaying and accessing the contents (e.g., bagged items) of the container.

Blank and Blank Assembly to Form Bag-In-Box Container

Referring to FIG. 1, an example of a blank 100 suitable for forming a bag-in-box container (e.g., 10 of FIG. 2) according to this disclosure is schematically illustrated. The blank 100 comprises a plurality of panels and a plurality of flaps that are integrally formed from one sheet of material. In one non-limiting example, the blank 100 can be a die-cut out.

In one or more examples, the blank 100 can comprise a support panel 102, a pair of side panels 104, 108, a back panel 106, and a front panel 110. The panels 102, 104, 106, 108, and 110 are configured to form the sidewalls of the bag-in-box container 10, as shown in FIGS. 2A-2M. The front panel 110 and the support panel 102 can be disposed at opposite ends of the blank 100. The side panel 104 can be disposed adjacent the support panel 102 and the back panel 106 with the side panel 104 positioned between the support panel 102 and the back panel 106. The other side panel 108 can be disposed adjacent the back panel 106 and the front panel 110 with the side panel 108 positioned between the back panel 106 and the front panel 110. In these examples, adjacent panels 102, 104, 106, 108, and 110 are connected with one another at fold lines 120*a*-120*d* (e.g., predefined creases). In one or more examples, the fold lines 120*a*-120*d* can be substantially parallel. The support panel 102 is configured to be attached to the front panel 110 to assemble the bag-in-box container (e.g., 10 of FIG. 2) from the blank 100, as will be described in further detail below.

In one or more examples, the blank 100 can further comprise a plurality of upper flaps 112*a*, 114*a*, 116*a*, and 118*a* that are configured to cooperate with each other to enclose the top of the bag-in-box container 10. The plurality of upper flaps can comprise a first support panel flap 112*a*, a first side panel flap 114*a*, a first back panel flap 116*a*, and a first side panel flap 118*a* hingedly connected to the support panel 102, the side panel 104, the back panel 106, and the other side panel 108, respectively, at fold lines 122*a*.

The blank 100 can comprise a plurality of lower flaps 112*b*, 114*b*, 116*b*, and 118*b* that are configured to cooperate with each other to enclose the bottom of the bag-in-box container 10. The plurality of lower flaps can comprise a second support panel flap 112*b*, a second side panel flap 114*b*, a second back panel flap 116*b*, and a second side panel flap 118*b* hingedly connected to the support panel 102, the side panel 104, the back panel 106, and the other side panel 108, respectively, at fold lines 122*b*. Additionally, the lower flaps 112*b*, 114*b*, 116*b*, and 118*b* can comprise structures that can be erected into a plurality of legs upon which the bag-in-box container can stand, as will be described in more detail below. In one or more examples, the fold lines 122*a* and 122*b* are parallel or substantially parallel.

The blank 100 can have various dimensions. In one or more examples, the blank 100 comprises a front panel 110 and back panel 106 that are substantially the same size and side panels 104 and 108 that are substantially the same size so that the bag-in-box container 10 formed from the blank 100 has the shape of a rectangular prism. Additionally, it is contemplated that the relative dimensions of the various panels 102, 104, 106, 108, 110 and/or flaps 112, 114, 116, 118, can take into account any spacing requirements for providing separation or gaps between the flaps 112, 114, 116, 118, and/or the thickness of the support panel 102 that is attached to the front panel 110.

The blank 100 can be composed of various materials including recycled materials. As an example, the blank 100 may be fabricated from a wide variety of suitable materials including, but not limited to, paper, cardboard (corrugated and otherwise), wood, metal, and plastic. For reasons of strength and economy, materials for the bag-in-box containers of the present disclosure typically include corrugated cardboard.

In one or more examples, the front panel 110 can include a severable portion 126 that is configured to be removable. In some non-limiting examples, the severable portion 126 can be bounded by a first line of weakness 124 formed in the front panel 110. The first line of weakness 124 can comprise a frangible boundary that forms a region of weakness in the front panel 110. In these examples, the severable portion 126 is configured to be separable and removable from the front panel 110 along the first line of weakness 124 that defines the severable portion 126. Removal of the severable portion 126 can provide access to a tap dispenser (e.g., 20 of FIG. 2C) located within the bag-in-box container. It is contemplated that the severable portion 126 is not limited to the particular shape and configuration illustrated in FIG. 1 and can be formed in other shapes, sizes, and/or locations of the front panel 110. In some non-limiting examples, the severable portion 126 is generally elliptical in shape.

In one or more examples, the front panel 110 can include an aperture 128 formed therein. The aperture 128 can be provided adjacent the first line of weakness 124 or can be provided in the severable portion 126 so that a consumer can grasp the severable portion 126 and tear the severable portion 126 from the front panel 110. In some non-limiting examples, the aperture 128 is disposed proximate an upper portion of the severable portion 126. In one example configuration, as depicted in FIG. 1, the aperture 128 has the shape of a semicircle with a semicircle base defined by the severable portion 126 and a semicircle arc defined by the first panel 110.

In one or more examples, the support panel 102 can comprise a pivotable portion 132. The pivotable portion 132 is configured to be partially separable from the support panel 102 yet remain pivotably connected to the bag-in-box container. In some non-limiting examples, a some (e.g., a part or portion) of the pivotable portion 132 can be bounded by a second line of weakness 130 formed in the support panel 102. The second line of weakness 130 can comprise a frangible boundary that forms a region of weakness in the support panel 102. In these examples, the pivotable portion 132 is configured to be separated and disconnected from the support panel 102 along the second line of weakness 130 and to remain connected to the bag-in-box container, in particular to the support panel 102, at locations where the pivotable portion 132 is not bounded by the second line of weakness 130. This surviving connection between the pivotable portion 132 and the bag-in-box container (e.g., the support panel 102) can comprise a hinged connection, such as a living hinge, which permits movement of the pivotable portion 132 relative to the bag-in-box container about the hinged connection. In this manner, the pivotable portion 132 can pivot about its hinged connection with the support panel 102. In some non-limiting examples, the bottom of the pivotable portion 132 is hingedly connected to the bag-in-box container at fold line 122*b*.

In one or more examples, the support panel 102 can further comprise a third line of weakness 134 formed in the pivotable portion 132. In these examples, the second line of weakness 130 and the third line of weakness 134 can together define a second severable portion 136 that is configured to be removable along the second and third lines of weakness 130 and 134. Removal of the second severable portion 136 from the pivotable portion 132 can form a recess in the top of the pivotable portion 132 having a size and shape that is configured to engage a notch formed in the tap dispenser, and thereby support and keep stable and level the tap dispenser. In some non-limiting examples, the recess is a curved to accommodate a cylindrical portion of the tap dispenser.

The pivotable portion 132 is configured with dimensions that generally align with the severable portion 126 for reasons that will be described in further detail below. In some non-limiting examples, the pivotable portion 132 is elliptical with dimensions that generally correspond to the dimensions of the severable portion 126. It is contemplated that the pivotable portion 132 is not limited to the particular shape and configuration illustrated in FIG. 1 and can be formed in other shapes, sizes, and/or locations of the support panel 102 provided the pivotable portion 132 generally aligns with the severable portion 126.

The weakening of the region of the front panel 110, which comprises the first line of weakness 124, and the weakening of the region of the support panel 102, which comprises the second line of weakness 130 and, in some examples the third line of weakness 134, may be accomplished by full or partial perforation of the relevant panel material, full or partial scoring thereof, partial severing, or any other suitable method known in the art. Whatever the method of forming the lines of weakness, the lines of weakness can exhibit sufficient strength to survive shipping and handling of the container without premature rupture while remaining sufficiently easy to rupture to facilitate opening and leave a reasonably well defined opening upon removal of one or both of the severable portions 126 and 136.

In one or more examples, one or more of the upper flaps 112*a*, 114*a*, 116*a*, and 118*a* can include adhesive 138, for example glue beads or lines, to secure the upper flaps together in a sequence that will be described in more detail below. Similarly, one or more of the lower flaps 112*b*, 114*b*, 116*b*, and 118*b* can include adhesive 138, for example glue beads or lines, to secure the lower flaps together in a sequence that will be described in more detail below. In one example configuration, as illustrated in FIG. 1, the first and second support panel flaps 112*a* and 112*b*, the first and second back panel flaps 116*a* and 116*b*, and the first and second side panel flaps 118*a* and 118*b* each contain one or more strips and/or beads of adhesive 138.

In one or more examples, the first side panel flap 114*a* can comprise a cutout or opening 140. The opening 140 can be of a size and shape configured to receive a dosing cup (e.g., 30 of FIG. 2M). In this manner, the opening 140 can serve as a storage location for the dosing cup when the bag-in-box container (e.g., 10 in FIG. 2A-2M) is assembled by the customer.

In one or more examples, the lower flaps 112*b*, 114*b*, 116*b*, and 118*b* can comprise structures that can be erected into a plurality of legs upon which the bag-in-box container 10 can stand. These legs can elevate the bag-in-box container 10 so that the consumer can conveniently fit a receptacle, for example the dosing cup, beneath the tap dispenser.

In one or more examples, the second support panel flap 112*b* can comprise a first flap 142. The first flap 142 can comprise a first proximal portion 144 and a first distal portion 146 that are hingedly connected at a first hinge line 148 (e.g., fold line or predefined crease). The first flap 142 can be configured to disconnect and separate from the second support panel flap 112*b* along boundary portions of the first flap 142 that are defined by a line of weakness (e.g., full or partial perforations and/or scoring) formed in the second support panel flap 112*b*. In these non-limiting examples, the first flap 142 can be configured to stay hingedly connected to the bag-in-box container 10 at the proximal end of the first proximal portion 144. The first flap 142 can further comprise a first hole 154.

The first distal portion 146 can comprise first prongs 150 protruding from a distal end of the first distal portion 146. The first prongs 150 can be arranged at opposite sides of the distal end of the first distal portion 146 thereby providing a space between the first prongs 150 that can be configured to accommodate a complimentary structure, such as a first flap engaging member 170. The first flap engaging member 170 can be retained in the space between the first prongs 150 by physical engagement between the first prongs 150 and the first flap engaging member 170. The first distal portion 146 can further comprise first fold lines 152, or predefined creases, that permit the first prongs 150 to be arranged at an angle (e.g., non-planar) relative to the plane of the first distal portion 146 to reduce disengagement and withdrawal of the first prongs 150 from the first flap engaging member 170.

In one or more examples, the second back panel flap 116*b* can comprise a second flap 156. The second flap 156 can be structured the same as the first flap 142 in pertinent part. The second flap 156 can comprise a second proximal portion 158 and a second distal portion 160 that are hingedly connected at a second hinge line 162 (e.g., fold line or predefined crease). The second flap 156 can be configured to disconnect and separate from the second back panel flap 116*b* along boundary portions of the second flap 156 that are defined by a line of weakness (e.g., full or partial perforations and/or scoring) formed in the second back panel flap 116*b*. In these implementations, the second flap 156 can be configured to stay hingedly connected to the bag-in-box container 10 at the proximal end of the second proximal portion 158. The second flap 156 can further comprise a second hole 168.

The second distal portion 160 can comprise second prongs 164 protruding from a distal end of the second distal portion 160. The second prongs 164 can be arranged at opposite sides of the distal end of the second distal portion 160 thereby providing a space between the second prongs 164 that can be configured to accommodate a complimentary structure, such as a second flap engaging member 172. The second flap engaging member 172 can be retained in the space between the second prongs 164 by physical engagement between the second prongs 164 and the second flap engaging member 172. The second distal portion 160 can further comprise second fold lines 166, or predefined creases, that permit the second prongs 164 to be arranged at an angle (e.g., non-planar) relative to the plane of the second distal portion 160 to reduce disengagement and withdrawal of the second prongs 164 from the second flap engaging member 172.

In one or more examples, the second side panel flap 114*b* can comprise a first flap engaging member 170 and a second flap engaging member 172. The first flap engaging member 170 can be defined by a line of weakness along a portion of its boundary to permit the first flap engaging member 170 to partially disconnect and separate from the second side panel flap 114*b* along that portion of its boundary defined by the line weakness (e.g., full or partial perforations and/or scoring). The first flap engaging member 170 is configured to remain connected to the second side panel flap 114*b* along the portion of its boundary that is not defined by a line of weakness. In some non-limiting examples, the first flap engaging member 170 can be hingedly connected to the second side panel flap 114*b* along a hinge line 174 formed where the first flap engaging member 170 is not bounded by a line of weakness. The first flap engaging member 170 can include angled portions 176 that are configured to engage the first prongs 150 in a manner that will be described in more detail below.

The first flap engaging member 170 can further comprise a first tab 178. The first tab 178 can be defined by a line of weakness along a portion of its boundary to permit the first tab 178 to partially disconnect and separate from the first flap engaging member 170 along that portion of its boundary defined by the line of weakness (e.g., full or partial perforations and/or scoring). The first tab 178 is configured to remain connected to the first flap engaging member 170 along the portion of its boundary that is not defined by a line of weakness. In some non-limiting examples, the first tab 178 can be hingedly connected to the first flap engaging member 170 via a first tab connection 179 formed where the first tab 178 is not bounded by a line of weakness.

The second flap engaging member 172 can be structured the same as the first flap engaging member 170 in pertinent part. The second flap engaging member 172 can be defined by a line of weakness along a portion of its boundary to permit the second flap engaging member 172 to partially disconnect and separate from the second side panel flap 114*b* along that portion of its boundary defined by the line weakness (e.g., full or partial perforations and/or scoring). The second flap engaging member 172 is configured to remain connected to the second side panel flap 114*b* along the portion of its boundary that is not defined by a line of weakness. In some non-limiting examples, the second flap engaging member 172 can be hingedly connected to the second side panel flap 114*b* along a hinge line 180 formed where the second flap engaging member 172 is not bounded by a line of weakness. The second flap engaging member 172 can include angled portions 182 that are configured to engage the second prongs 164 in a manner that will be described in more detail below.

The second flap engaging member 172 can further comprise a second tab 184. The second tab 184 can be defined by a line of weakness along a portion of its boundary to permit the second tab 184 to partially disconnect and separate from the second flap engaging member 172 along that portion of its boundary defined by the line of weakness (e.g., full or partial perforations and/or scoring). The second tab 184 is configured to remain connected to the second flap engaging member 172 along the portion of its boundary that is not defined by a line of weakness. In some non-limiting examples, the second tab 184 can be hingedly connected to the second flap engaging member 172 via a second tab connection 185 formed where the second tab 184 is not defined by a line of weakness.

In one or more examples, the second side panel flap 118*b* can comprise a first recess 186 and a second recess 188 to make consumer assembly of the bag-in-box container simpler, as will be explained in more detail below.

In one or more examples, the blank 100 can be assembled, or converted, into the bag-in-box container 10 by folding the support panel 102 along fold lines 102*a*, 120*b* in the direction 190 of the back panel 106 such that the support panel 102 is disposed over the back panel 106. The support panel 102 is folded so that an outer surface of the support panel 102, which can include an adhesive 138, such as glue, is exposed. In some non-limiting examples, the support panel 102 may include multiple strips or beads of adhesive 138, as shown in FIG. 1. It is contemplated that the surface of the support panel 102 may contain any suitable adhesive pattern and is not limited to any specific number of strips.

In one or more examples, the front panel 110 is then folded along fold lines 120*c*, 120*d* in the direction 192 of the support panel 102 for attachment to the support panel 102 via the adhesive 138. In this example, the strips of adhesive 138 are disposed on the support panel 102. But, in other examples, the strips of adhesive may be disposed on the front panel 110 (e.g., 138 in FIG. 1) or on both the front panel 110 and the support panel 102. The strips of adhesive 138 are then adhered, or otherwise affixed to an inner surface, or mating surface, of the front panel 110 thereby securing the front panel 110 to the support panel 102. In this manner, the front panel 110 overlaps with the support panel 102 and the support panel 102 reinforces the front panel 110 by providing a double layer of material. This provides increased thickness at the front panel 110 resulting in improved structural integrity and stacking strength of the container 10 while simultaneously making the container 10 more resistant to inadvertent perforations of the first and second lines of weakness 124, 130. At this stage, the panels 102, 104, 106, 108, and 110 form the general three-dimensional shape of the container 10, but the flaps 112-118 are still unsecured.

In one or more examples, the top of the bag-in-box container 10 can be formed from the plurality of upper flaps 112*a*, 114*a*, 116*a*, and 118*a* by first folding the first side panel flap 118*a* inwardly along fold line 122*a* such that the adhesive 138 is on the outer surface of the first side panel flap 118*a*. In this example, the one or more strips of adhesive 138 are disposed on the first side panel flap 118*a*. Next, the first support panel flap 112*a* and the first back panel flap 116*a* can each be folded inwardly (i.e., into the interior of the container 10) along fold lines 122*a* for attachment to the first side panel flap 118*a*. The strips of adhesive 138 included on the first side panel flap 118*a* are then adhered, or otherwise affixed to an inner surface, or mating surface, of the first support panel flap 112*a* and the first back panel flap 116*a* thereby securing the flaps 112*a* and 116*a* onto the flap 118*a*. In this example, the first support panel flap 112*a* and the first back panel flap 116*a* each contain adhesive 138, such as one or more strips or beads, on their outer surface to secure the last remaining flap 114*a*. Finally, the first side panel flap 114*a* can be folded inwardly along fold line 122*a* for attachment to the first support panel flap 112*a* and the first back panel flap 116*a*. The strips of adhesive 138 included on the first support panel flap 112*a* and the first back panel flap 116*a* are then adhered, or otherwise affixed to an inner surface, or mating surface, of the first side panel flap 114*a* thereby securing the flap 114*a* to flaps 112*a* and 116*a*. The adhesive on the first support panel flap 112*a* and the first back panel flap 116*a* is arranged so as not to flow into or be present in the opening 140 that is configured to store the dosing cup 30.

In one or more examples, the bottom of the bag-in-box container 10 can be formed from the plurality of lower flaps 112*b*, 114*b*, 116*b*, and 118*b* by first folding the second side panel flap 118*b* inwardly along fold line 122*b* such that the adhesive 138 is on the outer surface of the second side panel flap 118*b*. In this example, the one or more strips of adhesive 138 are disposed on the second side panel flap 118*b* on opposing sides of the first and second recesses 186 and 188. Next, the second support panel flap 112*b* and the second back panel flap 116*b* can each be folded inwardly (i.e., into the interior of the container 10) along fold lines 122*b* for attachment to the second side panel flap 118*b*. The strips of adhesive 138 included on the second side panel flap 118*b* are then adhered, or otherwise affixed to an inner surface, or mating surface, of the second support panel flap 112*b* and the second back panel flap 116*b* thereby securing the flaps 112*b* and 116*b* to the flap 118*a*. The adhesive 138 is arranged at locations on the second side panel flap 118*b* so as to avoid adhering, or otherwise affixing, the first flap 142 and/or the second flap 156 to the second side panel flap 118*b* which would prevent erection of the legs upon which the bag-in-box container 10 can stand. In this example, the second support panel flap 112*b* and the second back panel flap 116*b* each contain adhesive 138, such as one or more strips or beads, on their outer surface to secure the last remaining flap 114*b*. Finally, the second side panel flap 114*b* can be folded inwardly along fold line 122*b* for attachment to the second support panel flap 112*b* and the second back panel flap 116*b*. The strips of adhesive 138 included on the second support panel flap 112*b* and the second back panel flap 116*b* are then adhered, or otherwise affixed to an inner surface, or mating surface, of the second side panel flap 114*b* thereby securing the flap 114*b* to flaps 112*b* and 116*b*. The adhesive on the second support panel flap 112*b* and the second back panel flap 116*b* is arranged so as to avoid adhering, or otherwise affixing, the first flap engaging member 170 to the first flap 142 and/or the second flap engaging member 172 to the second flap 156 which would prevent erection of the legs upon which the bag-in-box container 10 can stand.

Bag-In-Box Container Conversion

Referring now to FIGS. 2-3, there are perspective views of the bag-in-box container 10 at various stages of modification/conversion for use by a consumer. FIGS. 2A-2M are perspective views of a bag-in-box container 10 according to this disclosure. The bag-in-box container 10 comprises a self-contained liquid delivery system that includes a flexible bag and dispensing tap stored within the interior of the bag-in-box container 10. The flexible bag can contain a liquid. A dosing cup 30 can also be provided as part of the bag-in-box container 10. The dosing cup 30 can be provided in the interior to the bag-in-box container 10 or set within a recess in the exterior of the bag-in-box container 10.

In one or more examples, the bag-in-box container 10 can be rectangular parallelpiped. The bag-in-box container 10 comprises a front panel 110 that is a dispensing side of the bag-in-box container 10, a back panel 106 opposite the front panel 110, opposing side panels 104 and 108 connecting the front panel 110 to the back panel 106, a plurality of lower flaps 112*b*, 114*b*, 116*b*, and 118*b* that together form the bottom of the bag-in-box container 10, and a plurality of upper flaps 112*a*, 114*a*, 116*a*, and 118*a* that together form the top of the bag-in-box container 10. The bag-in-box container 10 can have various features that make the bag-in-box container 10 convenient to use.

In one or more examples, the bag-in-box container 10 can comprise a support panel 102 attached to the front panel 110 in which the front panel 110 overlaps with the support panel 102. The front panel 110 can comprise a severable portion 126 bounded by a first line of weakness 124 formed in the front panel 110. The support panel can comprise a pivotable portion 132 bounded by a second line of weakness 130 formed in the support panel 102. The pivotable portion 132 can have dimensions that generally align with the severable portion 126 such that both the pivotable portion 132 and severable portion 126 are moved in order to provide access to the tap dispenser 20.

To access the tap dispenser 20 located within the bag-in-box container 10 force can be applied to the severable portion 126 to break the first line of weakness 124 and to the pivotable portion 132 to break the second line of weakness 130. In one or more examples, force is directly applied to the severable portion 126 and indirectly to the pivotable portion 132 behind it, by pushing inwardly towards the interior of the bag-in-box container 10 to break the first and second lines of weakness 124 and 130.

In one or more other examples, the severable portion 126 can be pulled away from the bag-in-box container 10 to remove the severable portion 126. This can be accomplished by a consumer inserting fingers into an aperture 128 formed in the front panel 110. The aperture 128 can be formed adjacent the first line of weakness 124 or can be provided in the severable portion 126 so that the user can use their fingers to grasp the first severable portion 126 and remove the severable portion 126 from the front panel 110. The aperture 128 also provides access for a consumer to directly apply force to the pivotable portion 132 and, in particular, to a second severable portion 136 that is defined by the second line of weakness 130 and a third line of weakness 134 formed in the pivotable portion 132.

Figure 2A:
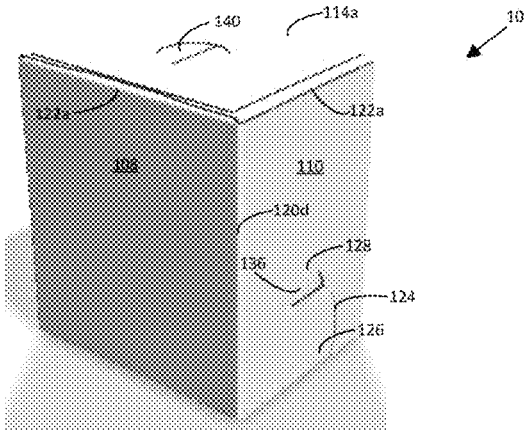
FIGS. 2A-2M are perspective views of a bag-in-box container at various stages of assembly in which the bag-in-box container is formed from the blank shown in FIG. 1.
Figure 2B:
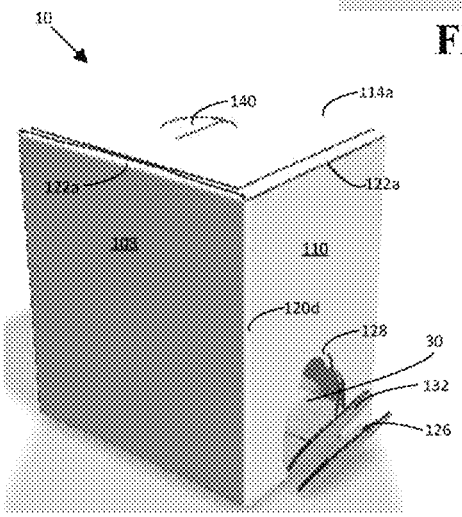
Figure 2C:
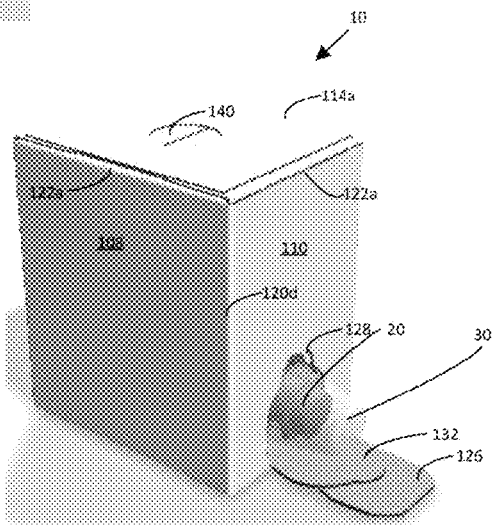
Figure 2D:
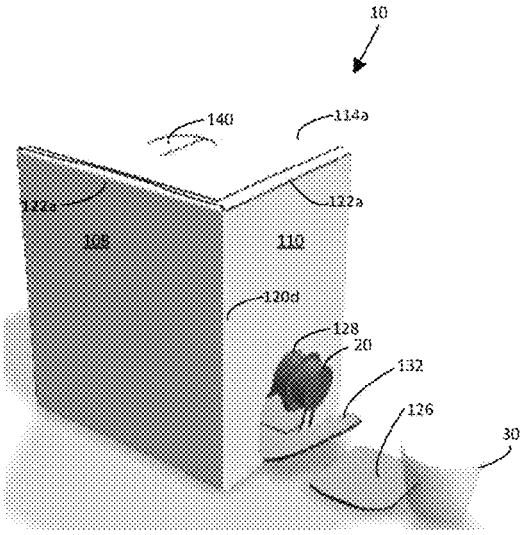
Figure 2E:
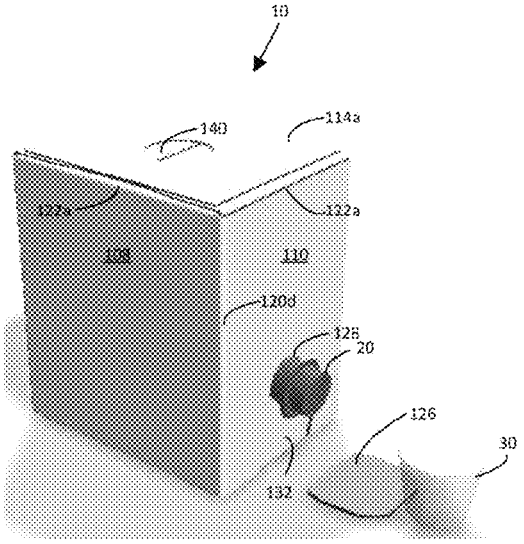
Figure 2F:
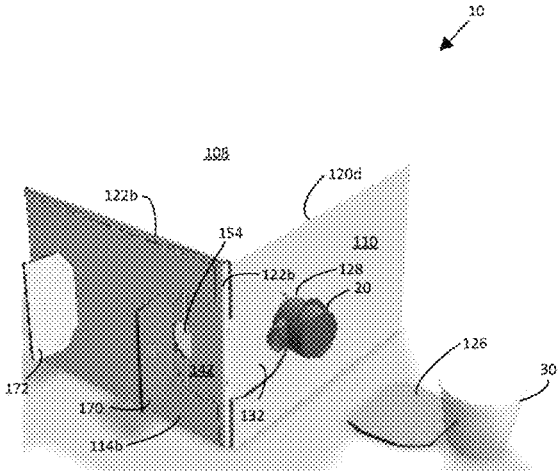
Figure 2G:
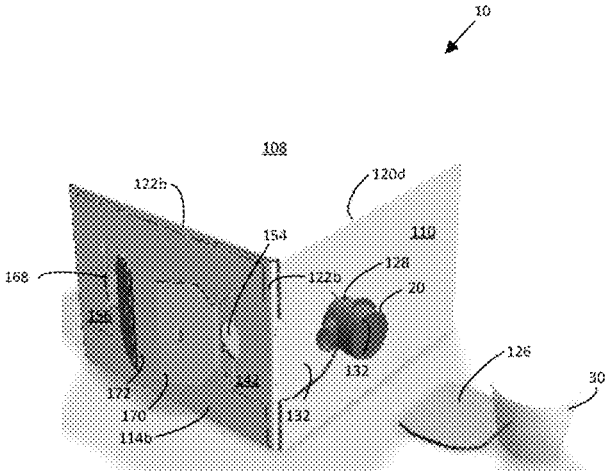
Figure 2H:
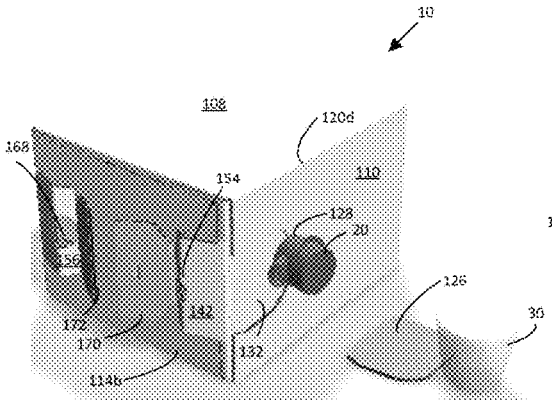
Figure 2I:
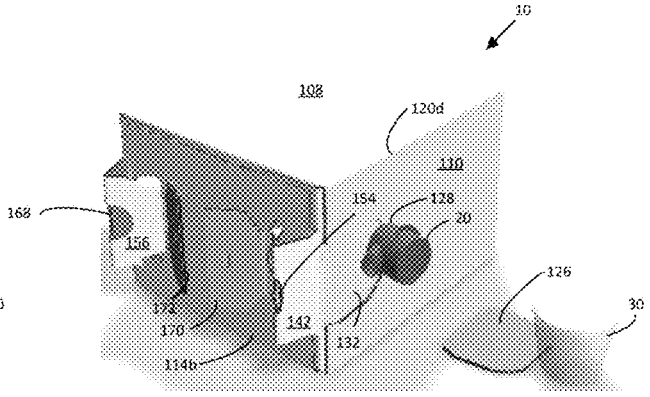
Figure 2J:
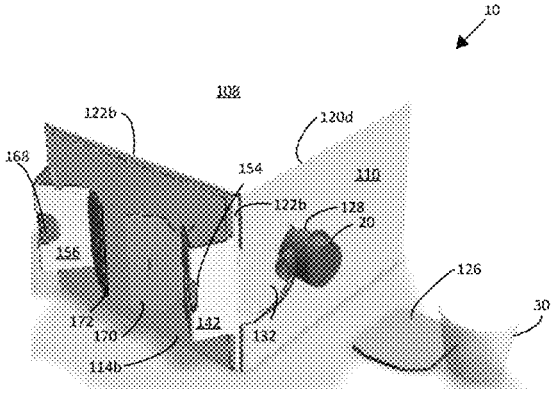
Figure 2K:
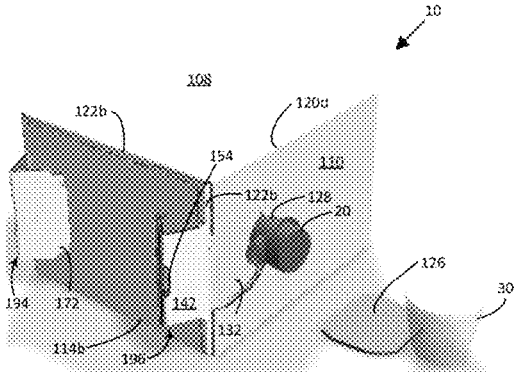
Figure 2L:
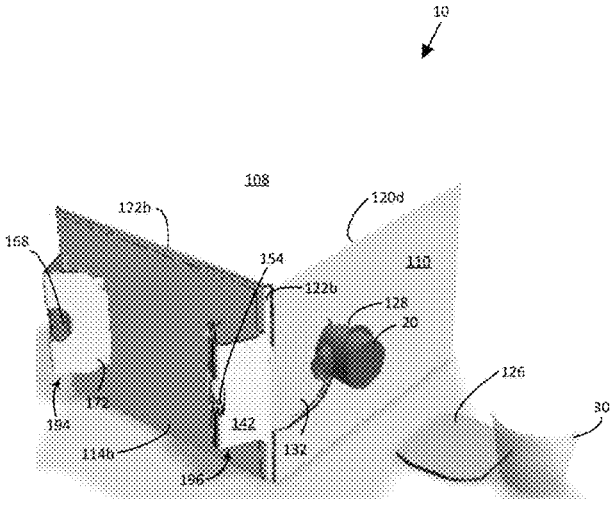
Figure 2M:
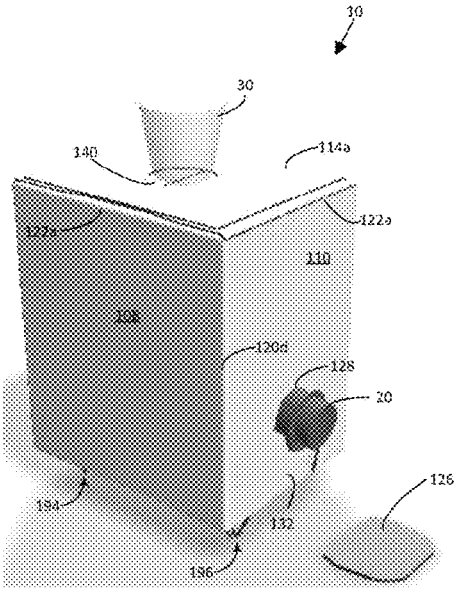
Figure 3A:
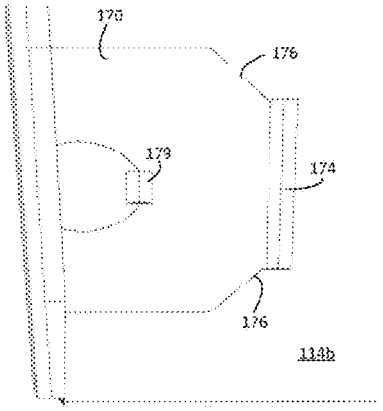
FIGS. 3A-3E are partial perspective views of the legs of the bag-in-box container at various stages of erection, in accordance with this disclosure.
Figure 3B:
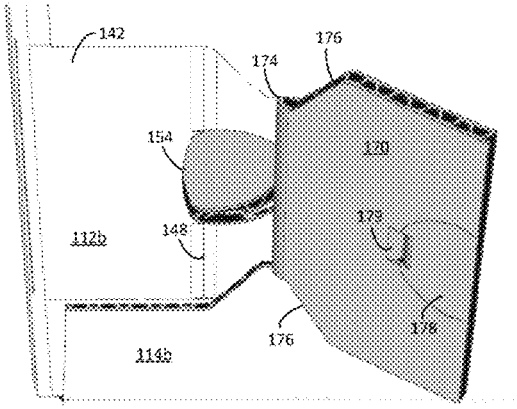
Figure 3C:
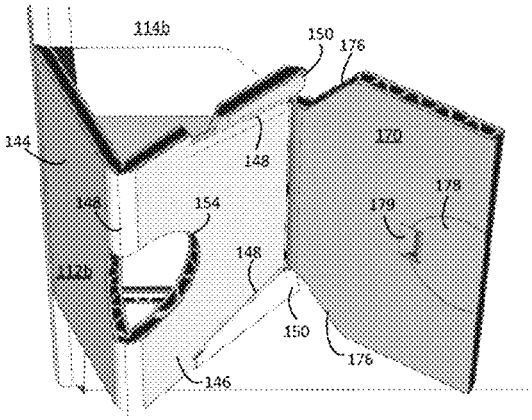
Figure 3D:
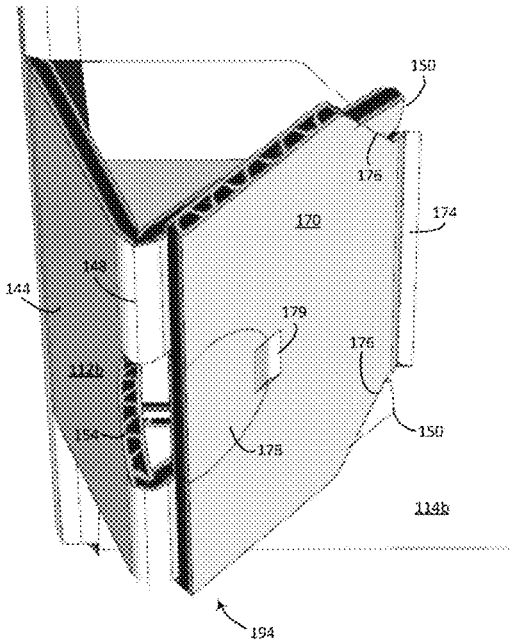
Figure 3E:
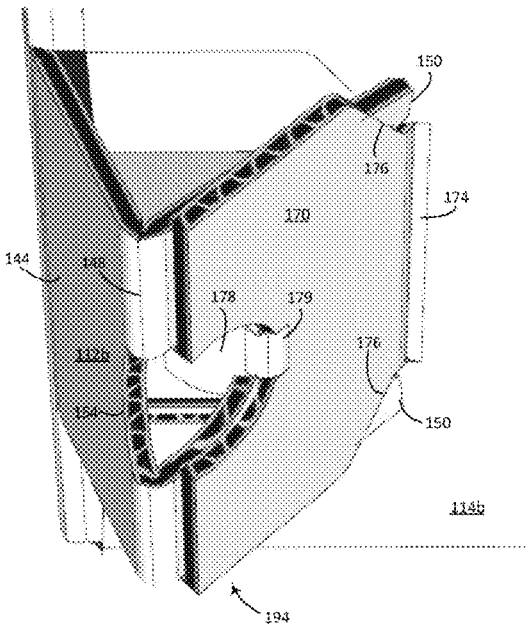

FIGS. 2B-2D are perspective views that show the severable portion 126 completely separated and removed from the front panel 110. The pivotable portion 132 has been partially separated or disconnected from the support panel 102 along the second line of weakness 130 while remaining hingedly attached to the support panel 102 at the bottom of the pivotable portion 132. In this manner, the pivotable portion 132 is moved back into position once the tap dispenser 20 and dosing cup 30 have been removed from the interior of the bag-in-box container 10, as shown in FIGS. 2D-2E. In some non-limiting examples, the second severable portion 136 can be removed forming a curved recess in the pivotable portion 132 that is configured to engage a notch of the tap dispenser to hold the tap dispenser stable and level, as shown in FIG. 2E.

Referring now to FIGS. 2F-2M and 3A-3E, there are illustrated perspective views of the various stages of assembly for erecting the plurality of legs upon which the bag-in-box container 10 can stand. These legs 194, 196 can elevate the bag-in-box container 10 so that the consumer can conveniently fit a receptacle such as a cup or dosing cup 30 beneath the tap dispenser 20. In one or more examples, the bag-in-box container 10 comprises a first leg 194 and a second leg 196 each configured to extend from the bottom of the bag-in-box container 10. The first leg 194 can comprise the first flap 142 and the first flap engagement member 170. The second leg 196 can comprise the second flap 156 and the second flap engagement member 172.

To erect the first and second legs 194 and 196 at the bottom of the bag-in-box container 10, the first and second flap engaging members 170 and 172 are respectively freed from (e.g., disengaged from) the second side panel flap 114*b*. In one or more examples, the first flap engaging member 170 partially disconnects and separates from the second side panel flap 114*b* along its boundary portion that is defined by a line weakness (e.g., full or partial perforations and/or scoring) and remains hingedly connected to the second side panel flap 114 along hinge line 174 where the boundary of the first flap engaging member 170 is not defined by a line of weakness. Similarly, the second flap engaging member 172 partially disconnects and separates from the second side panel flap 114*b* along its boundary portion that is defined by a line weakness (e.g., full or partial perforations and/or scoring) and remains hingedly connected to the second side panel flap 114 along hinge line 180 where the boundary of the second flap engaging member 172 is not defined by a line of weakness.

Moving each of the first and second flap engaging members 170 and 172 about their hinged connections 174 and 180 inwardly toward the interior of the bag-in-box container 10 exposes a portion of the first and second flaps 142 and 156 previously concealed. The first flap 142 can be pulled out from underneath the first flap engaging member 170. In particular, the first flap 142 can be configured to disconnects and separate from the second support panel flap 112*b* along boundary portions of the first flap 142 that are defined by a line of weakness (e.g., full or partial perforations and/or scoring) formed in the second support panel flap 112*b*. The first flap 142 can be folded along the first hinge line 148 that divides the first flap 142 into a first proximal portion 144 and a first distal portion 146 thereby forming a triangular structure.

To complete assembly of the first leg 194, the first distal portion 146 is moved towards the first flap engaging member 170 until the first flap engaging member 170 is received in the space between the first prongs 150. At this stage, the first flap engaging member 170 is accommodated between the first prongs 150 with the first prongs 150 positioned outside the lower body of first flap engaging member 170 beneath the angled portions 176. The first flap engaging member 170 can be can be retained in the space between the first prongs 150 by physical engagement (e.g., friction) between the first prongs 150 and the first flap engaging member 170. The first prongs 150 can be arranged at an angle (e.g., non-planar) relative to the plane of the first distal portion 146 to assist with engaging the angled portions 176 of the first flap engaging member 170.

Next, the first flap engaging member 170 is pivoted about hinge line 174 towards the first flap 142 until a bottom surface of the first flap engaging member 170 engages the first distal portion 146 of the first flap 142. Once the first distal portion 146 and first flap engaging member 170 are engaged, the first tab 178 on the first flap engaging member 170 is pressed into first hole 154 on the first flap 142 to form a locking mechanism.

In similar fashion, the second flap 156 can be pulled out from underneath the second flap engaging member 172. In particular, the second flap 156 can be configured to disconnects and separate from the second support panel flap 112*b* along boundary portions of the second flap 156 that are defined by a line of weakness (e.g., full or partial perforations and/or scoring) formed in the second support panel flap 112*b*. The second flap 156 can be folded along the second hinge line 162 that divides the second flap 156 into a second proximal portion 158 and a second distal portion 160 thereby forming a triangular structure.

To complete assembly of the second leg 196, the second distal portion 160 is moved towards the second flap engaging member 172 until the second flap engaging member 172 is received in the space between the second prongs 164. At this stage, the second flap engaging member 172 is accommodated between the second prongs 164 with the second prongs 164 positioned outside the lower body of second flap engaging member 172 beneath the angled portions 182. The second flap engaging member 172 can be can be retained in the space between the second prongs 164 by physical engagement (e.g., friction) between the second prongs 164 and the second flap engaging member 172. The second prongs 164 can be arranged at an angle (e.g., non-planar) relative to the plane of the second distal portion 160 to assist with engaging the angled portions 182 of the second flap engaging member 172.

Next, the second flap engaging member 172 is pivoted about hinge line 180 towards the second flap 156 until a bottom surface of the second flap engaging member 172 engages the second distal portion 160 of the second flap 156. Once the second distal portion 160 and second flap engaging member 172 are engaged, the second tab 184 on the second flap engaging member 172 is pressed into second hole 168 on the second flap 156 to form a locking mechanism.

One particular advantage of this disclosure is that the plurality of legs 194, 196 described above have multiple securing mechanisms. For example, the legs each include frictional retention between the prongs and the flap engaging members as well as tab-hole interlocking mechanisms. Moreover, these forms of retention offer greater reliability and strength. Thus, the bag-in-box container 10 formed by the blank 100 of this disclosure can be assembled and secured in a simple and cost-effective manner.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A bag-in-box container comprising:

a plurality of panels, a plurality of lower flaps, and a plurality of upper flaps integrally formed in a blank, the plurality of panels including a support panel, a side panel adjacent the support panel, a back panel adjacent the side panel, another side panel adjacent the back panel, and a front panel adjacent the side panel, wherein adjacent panels are connected with one another, the plurality of upper flaps being configured to cooperate with each other to enclose a top of the bag-in-box container, and the plurality of lower flaps being configured to cooperate with each other to enclose a bottom of the bag-in-box container, the plurality of lower flaps comprising:

a support panel flap hingedly connected to the support panel, the support panel flap comprising a first flap;

a back panel flap hingedly connected to the back panel, the back panel flap comprising a second flap; and a side panel flap hingedly connected to the side panel, the side panel flap comprising a first flap engaging member and a second flap engaging member;

a first leg configured to extend from the bottom of the bag-in-box container, the first leg comprising the first flap and the first flap engaging member;

a second leg configured to extend from the bottom of the bag-in-box container, the second leg comprising the second flap and the second flap engaging member; and a first line of weakness formed in the front panel, wherein the first line of weakness defines a severable portion of the front panel that is configured to be removable; and a second line of weakness formed in the support panel, wherein the second line of weakness defines a pivotable portion that is configured to be hingedly connected to the bag-in-box container, the support panel being fixedly attached to an inner surface of the front panel such that the first severable portion and the pivotable portion are generally aligned.

2. The bag-in-box container of claim 1, wherein the first flap engaging member has a first tab configured to engage a first hole in the first flap to form a locking mechanism to secure the first flap engaging member to the first flap.

3. The bag-in-box container of claim 2, wherein the second flap engaging member has a second tab configured to engage a second hole in the second flap to form a locking mechanism to secure the second flap engaging member to the second flap.

4. The bag-in-box container of claim 1, wherein:

the first flap comprises first prongs extending from a distal end of the first flap, the first prongs configured to engage the first flap engaging member between the first prongs; and the second flap comprises second prongs extending from a distal end of the second flap, the second prongs configured to engage the second flap engaging member between the second prongs.

5. The bag-in-box container of claim 1, wherein the first flap has first prongs extending from a distal end of the first flap and configured to engage the first flap engaging member between the first prongs.

6. The bag-in-box container of claim 5, wherein the second flap has second prongs extending from a distal end of the second flap and configured to engage the second flap engaging member between the second prongs.

7. The bag-in-box container of 6, wherein:

the first flap includes first fold lines configured to arrange the first prongs at an angle relative to a distal portion of the first flap; and the second flap includes second fold lines configured to arrange the second prongs at an angle relative to a distal portion of the second flap.

8. The bag-in-box container of claim 1, wherein the plurality of upper flaps comprises a side panel flap having an opening configured to receive a dosing cup.

9. The bag-in-box container of claim 1, wherein the support panel is fixedly attached to the interior surface of the front panel using adhesive.

10. The bag-in-box container of claim 1, further comprising a third line of weakness formed in the pivotable portion, wherein the third line of weakness defines a second severable portion that is configured to be removable.

11. The bag-in-box container of claim 10, wherein the third line of weakness defines a recess in the pivotable portion configured to support the tap dispenser at a level height.

12. A bag-in-box container comprising:

a plurality of panels, a plurality of lower flaps, and a plurality of upper flaps;

the plurality of panels including a support panel, a side panel adjacent the support panel, a back panel adjacent the side panel, another side panel adjacent the back panel, and a front panel adjacent the side panel, wherein adjacent panels are connected with one another, the plurality of upper flaps being configured to cooperate with each other to enclose a top of the bag-in-box container, wherein the plurality of upper flaps comprises a side panel flap hingedly connected to the side panel and having an opening configured to receive a dosing cup, and the plurality of lower flaps being configured to cooperate with each other to enclose a bottom of the bag-in-box container;

a plurality of legs that are configured to be erectable from the plurality of lower flaps;

a first line of weakness formed in the front panel, wherein the first line of weakness defines a severable portion of the front panel that is configured to be removable; and a second line of weakness formed in the support panel, wherein the second line of weakness defines a pivotable portion that is configured to be hingedly connected to the bag-in-box container, the support panel being fixedly attached to an inner surface of the front panel such that the first severable portion and the pivotable portion obstruct a tap dispenser from extending therethrough.

13. The bag-in-box container of claim 12, wherein the plurality of lower flaps comprises:

a support panel flap hingedly connected to the support panel, the support panel flap comprising a first flap;

a back panel flap hingedly connected to the back panel, the back panel flap comprising a second flap; and a side panel flap hingedly connected to the side panel, the side panel flap comprising a first flap engaging member and a second flap engaging member.

14. The bag-in-box container of claim 13, wherein the plurality of legs comprises a first leg comprising the first flap and the first flap engaging member.

15. The bag-in-box container of claim 14, wherein the plurality of legs comprises a second leg comprising the second flap and the second flap engaging member.

16. The bag-in-box container of claim 15, wherein the second flap engaging member has a second tab configured to engage a second hole in the second flap to form a locking mechanism to secure the second flap engaging member to the second flap.

17. The bag-in-box container of claim 14, wherein the first flap engaging member has a first tab configured to engage a first hole in the first flap to form a locking mechanism to secure the first flap engaging member to the first flap.

18. The bag-in-box container of claim 12, further comprising a third line of weakness formed in the pivotable portion, wherein the third line of weakness defines a second severable portion that is configured to be removable.

19. The bag-in-box container of claim 18, wherein the third line of weakness defines a recess in the pivotable portion configured to support the tap dispenser at a level height.

20. The bag-in-box container of claim 12, wherein the severable portion and the pivotable portion are generally aligned.

* * * * *